US007567159B2

(12) United States Patent
Macken

(10) Patent No.: US 7,567,159 B2
(45) Date of Patent: Jul. 28, 2009

(54) ENERGY ABSORBING MAGNETIC COUPLING DEVICE

(76) Inventor: John A. Macken, 233 Twin Pillar Way, Santa Rosa, CA (US) 95404

( * ) Notice: Subject to any disclaimer, the term of this patent is extended or adjusted under 35 U.S.C. 154(b) by 184 days.

(21) Appl. No.: 11/051,569

(22) Filed: Feb. 3, 2005

(65) Prior Publication Data

US 2006/0170225 A1 Aug. 3, 2006

(51) Int. Cl.
*E05C 17/56* (2006.01)

(52) U.S. Cl. ..... 335/306; 292/252; 292/251.5; 16/82; 16/49

(58) Field of Classification Search ..... 292/251.5, 292/252; 16/82, 49; 403/DIG. 1; 464/29; 188/267.2, 267; 70/276; 24/303; 335/306; 310/103

See application file for complete search history.

(56) References Cited

U.S. PATENT DOCUMENTS 3,184,654 A * 5/1965 Ahmet ..... 335/295
4,250,478 A * 2/1981 Cardone et al. ..... 335/288
4,251,791 A * 2/1981 Yanagisawa et al. ..... 335/302
4,459,500 A * 7/1984 Miyamoto ..... 310/154.21
4,686,841 A * 8/1987 Prunbauer et al. ..... 70/276
5,072,204 A * 12/1991 Leupold ..... 335/306
5,188,405 A * 2/1993 Maccaferri ..... 292/204
5,216,401 A * 6/1993 Leupold ..... 335/306
5,485,733 A * 1/1996 Hoffman ..... 70/276
6,066,088 A * 5/2000 Davis ..... 600/29
6,707,360 B2 * 3/2004 Underwood et al. ..... 335/288
6,765,330 B2 * 7/2004 Baur ..... 310/103
6,919,787 B1 * 7/2005 Macken ..... 335/285
2005/0062296 A1 * 3/2005 Lyon ..... 292/251.5

* cited by examiner

*Primary Examiner*—Patricia L Engle
*Assistant Examiner*—Mark Williams
(74) *Attorney, Agent, or Firm*—Craig M. Stainbrook; Stainbrook & Stainbrook, LLP

(57) ABSTRACT

A non-contact apparatus removes translational energy (slows movement) of a first magnetic assembly when it is moved through the magnetic field of a second magnet. The first magnetic assembly contains a magnet that can rotate, such as a diametrically magnetized cylindrical magnet in a cylindrical cavity. Rotation of the first magnet does work against a predetermined drag. The apparatus also forms a non-contact magnetic coupling that holds a predetermined relative position. The apparatus can be used as a door catch that slows down and quietly stops a door at a predetermined position.

14 Claims, 5 Drawing Sheets

ENERGY ABSORBING MAGNETIC COUPLING DEVICE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to latches and closing mechanisms, and more particularly to an improved magnetic coupling device such as can be used to slow down and quietly stop a door at a predetermined position relative to the doorframe.

BACKGROUND INFORMATION AND DISCUSSION OF RELATED ART

Doors to rooms typically have a well known latching mechanism to keep the door closed. To open this latching mechanism, it is necessary to turn a door handle. However, often doors to cabinets or closets do not have a latching mechanism. Instead merely pulling on a door handle typically opens these doors. A different type of mechanism is used to prevent these doors from inadvertently opening. The common name for a device that holds a door closed or open is a a "door catch". There are four common door catch designs. These are: spring-loaded hinges, ball detents, roller catches, and magnetic catches which have a magnet mounted to the doorframe and a piece of metal attached to the door.

It is not commonly recognized that it is very desirable for these door catches to also have some means to absorb energy from a closing door. Without an energy absorbing means, the doors slam against a stop and tend to bounce open unless they were closed carefully. Two magnets exhibiting either magnetic attraction or magnetic repulsion lack this energy absorbing property. Two attracting magnets tend to accelerate a closing door and decelerate an opening door. Two repelling magnets do the opposite. In either case there is no energy absorption mechanism. Non-latching doors with simple magnets would tend to bounce open unless they are closed with a narrow range of energy that can be absorbed by some other means.

Some known door-latching mechanisms include magnetic repulsion to slow a closing door. However, magnetic repulsion is elastic and the energy is returned to a door if there is any bounce.

For example, U.S. Pat. No. 5,782,512 discloses a magnetic field latch assembly for an apparatus having a first element and a second element with the second element having a disengaged position and an engaged position with respect to the first element. The magnetic field latch assembly employs permanent or electromagnets for shock absorption, positioning and latching the first element and the second element. The magnetic field latch assembly includes magnets associated with the first and second elements such that as the first and second elements approach each other, the magnets initially repel each other causing a braking force to slow the relative motion of the first and second elements. When the first and second elements are in the engaged position, the magnets hold the first and second elements in position and minimize vibration and chatter.

U.S. Pat. No. 6,588,811 describes a magnetic door stop/latch which contains a first magnet mounted on or within a door and a second magnet mounted on or within a structure opposing the door, such as a wall, door jamb, door frame or baseboard. When the door is moving towards the opposing structure, the magnetic doorstop may be used to prevent the door from slamming into the opposing structure by virtue of the repulsive forces of the magnets. The magnetic door stop/latch may be switched from repulsive configuration to an attractive configuration that holds the door in position.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

The invention described herein absorbs energy and changes the energy into heat. This is a non-contact device that can gently slow a closing door and quietly bring it to a stop at a predetermined point. Furthermore, the invention described herein can be used as a non-contact magnetic brake for other applications. Also, the invention provides a non-contact magnetic coupling device that tends to seek and hold a predetermined relative position of two component parts.

BRIEF SUMMARY OF THE INVENTION

The energy absorbing magnetic coupling device of this invention provides a non-contact magnetic device that exhibits both magnetic braking (energy absorption) and magnetic positioning. One application of this device is a door catch. The device can slow down a closing door, bring the door to a gentle and quiet stop, and then hold the door at a predetermined position.

The physical principle behind this device is that a properly mounted magnet (a rotary magnet) will rotate when it is translated across the fringing magnetic field of another magnet (a reference magnet). If the rotation of the rotary magnet is impeded by a substantial amount of friction or viscous drag, then magnetic forces between the two magnets will resist the translational motion. For example, the rotary magnet assembly can be affixed to a doorframe and the reference magnet can be affixed to the upper edge of a door. The kinetic energy of the closing door is converted into frictional heating without any physical contact between the two magnets. Furthermore, the two magnets will seek to hold the door at the predetermined point of closest approach.

The preferred embodiment has a cylindrical rotary magnet mounted in a cylindrical cavity. The cylindrical magnet is diametrically magnetized. The cavity permits the cylindrical magnet to rotate, but this rotation is impeded by a viscous material that causes a substantial amount of drag on the rotation. The rotary magnet can translate along a predetermined path relative to the reference magnet. The two magnets do not make contact, but they have a point of closest approach. Translating along this path exerts a torque on the cylindrical magnet and causes it to rotate inside the cavity. The viscous drag on the cylindrical magnet extracts energy from this rotation and converts this energy to heat. When there is the proper amount of drag, the orientation of the cylindrical magnet results in a magnetic force that opposes relative motion and slows down the door. The magnets will also stop the relative motion at the point of closest approach and resist movement away from this position.

This invention also teaches the use of a bias means that can align the rotary magnet to the optimum orientation for maximum energy removal. The bias means can be either a gravitational bias or a magnetic bias.

It is therefore an object of the present invention to provide a new and improved non-contact device that can gently slow a closing door and quietly bring it to a stop at a predetermined point.

It is another object of the present invention to provide a new and improved a non-contact magnetic brake.

A further object or feature of the present invention is a new and improved non-contact magnetic coupling device that seeks and holds a predetermined relative position of two component parts.

An even further object of the present invention is to provide a novel energy absorbing magnetic coupling device.

Other novel features which are characteristic of the invention, as to organization and method of operation, together with further objects and advantages thereof will be better understood from the following description considered in connection with the accompanying drawing, in which preferred embodiments of the invention are illustrated by way of example. It is to be expressly understood, however, that the drawing is for illustration and description only and is not intended as a definition of the limits of the invention. The various features of novelty, which characterize the invention, are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to give a brief and non-technical description of the invention. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
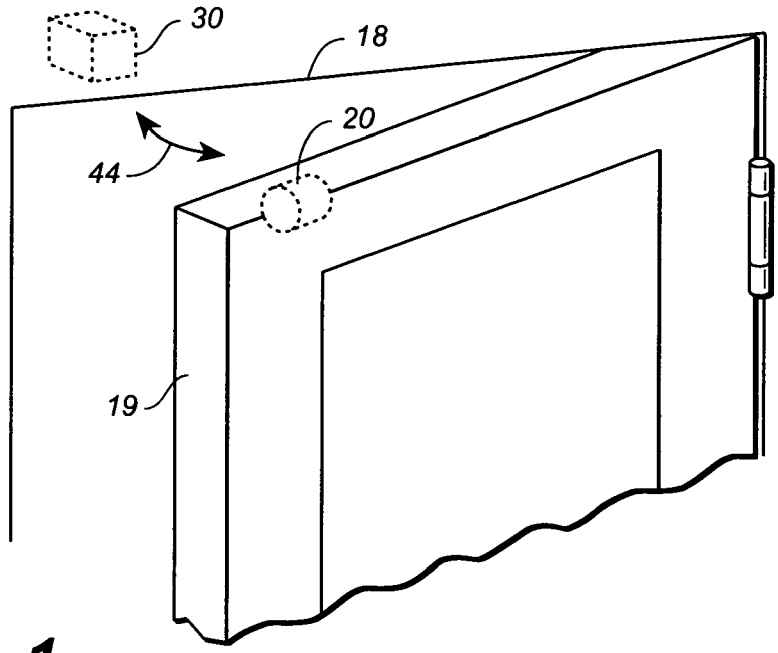
FIG. 1 is a perspective view of a door and doorframe with the two components of the energy absorbing magnetic coupling device of this invention.

Referring to FIGS. 1 through 9, wherein like reference numerals refer to like components in the various views, there is illustrated therein a new and improved energy absorbing magnetic coupling device.

This invention perhaps has its widest application as a non-contact means to remove energy (i.e., slow down) a closing door and hold the door closed in a predetermined position. However, the principles taught here have wider application to other uses requiring non-contact braking and non-contact coupling. Therefore, the example using doors should not limit the broader uses.

Doors to rooms typically have a well known latching mechanism to keep the door closed. To open this latching mechanism, it is necessary to turn a door handle. However, often doors to cabinets or closets do not have a latching mechanism. Instead merely pulling on a door handle typically opens these doors. A mechanism is used to prevent these doors from inadvertently opening. This mechanism is often called a door catch.

It is not commonly recognized that it is very desirable for door catches to have some means to absorb energy from a closing door. Without an energy absorbing means, a door would tend to bounce open unless the door was closed very carefully. Two inflexible magnets lack this energy absorbing property, and therefore they are not usually used to hold doors closed. The magnetic closure mechanisms that are used typically have a rocker mounting which absorbs some energy. Still, these are contact devices that are abrupt, make noise and only absorb a small amount of energy. It is therefore desirable to have a silent, non-contact mechanism that removes the optimum amount of energy from a closing door and holds the door in a predetermined closed position.

FIG. 1 is a perspective view of a slightly open door 19 and the upper part of the doorframe 18. The purpose of this figure is just to illustrate a typical placement of the non-contact magnetic coupling devices. Permanent magnet 30 (in phantom) is recessed into the doorframe. This magnet is a part of the energy absorbing magnetic coupling device that will be described in subsequent figures. Also FIG. 1 shows that there is a second cylindrical magnet 20 recessed into the upper part of the door. Other components of an energy absorbing magnetic coupling device are not shown in FIG. 1. Magnets 20 and 30 are positioned so that they are in close proximity (but not contacting) when the door is closed. Double arrow 44 shows the motion of a closing or opening door.

The objective is to provide a non-contact device that both removes energy from a closing door and provides a non-contact coupling that aligns the two magnets in a predetermined position to hold the door closed. To explain the theory of operation of this invention, it is necessary to start with the pattern of the magnetic field lines produced by a permanent magnet.

Figure 2:
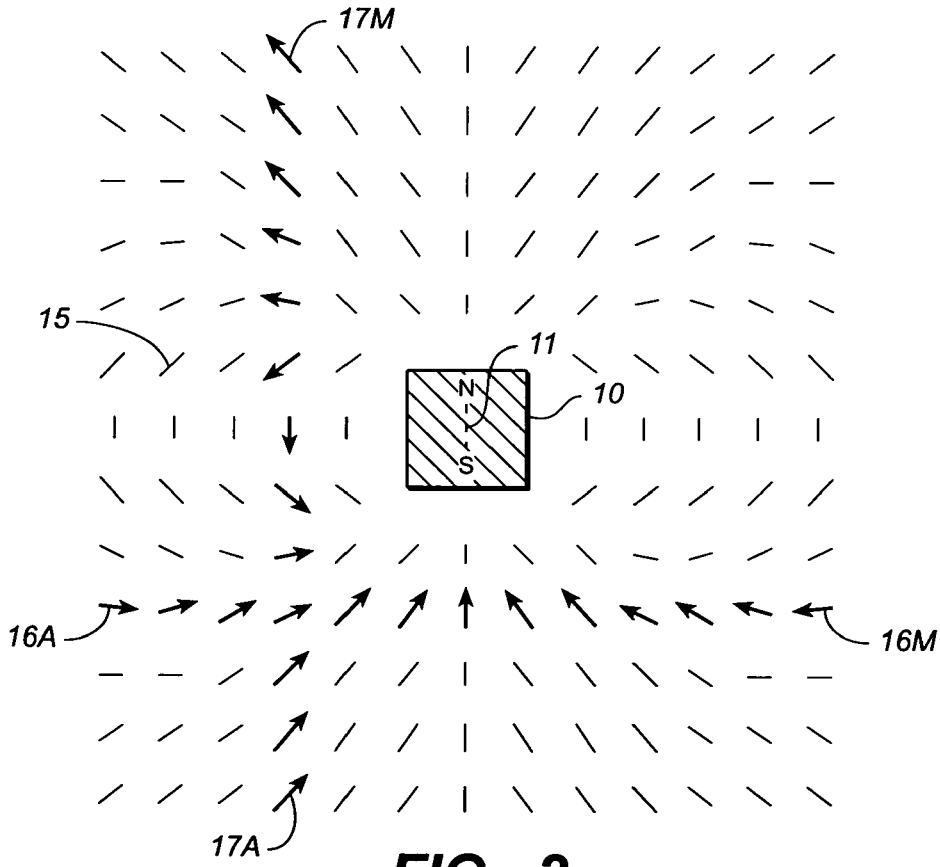
FIG. 2 illustrates a magnet and the orientation of the magnetic field lines.

FIG. 2 illustrates a permanent magnet 10 with north and south magnetic poles designated N and S. The magnetic axis 11 of the magnet is defined as an imaginary line connecting the strongest north and south points on the surface of the magnet. The magnetic field of a magnet can be visualized with the help of short pieces of iron wire 15. These small pieces of iron will align themselves with the magnetic field and reveal the orientation of the magnetic field at different locations.

FIG. 2 also contains some short arrows such as the arrows between points 16A and 16M. These arrows are similar to the iron wire line segments 15, except that the arrows also designate the direction of the magnetic field using the convention of the magnetic field propagation from the north to south magnetic poles. For example, these arrows represent the orientation that a compass needle or small bar magnet would take if placed at a particular location.

Presume that a small bar magnet is mounted in such a way to permit rotation in any direction. If this bar magnet was initially placed at point 16A and then translated to point 16M, the bar magnet would align itself with the local magnetic field. This would result in the bar magnet rotating as it is translated across the fringing magnetic field. In fact, the bar magnet would rotate about 180 degrees as it is translated between 16A and 16M as indicated by the arrow orientations between these two locations. The amount of rotation depends on the start and stop locations. It should be noted that the path between points 16A and 16M is perpendicular to the magnetic axis 11.

There is another set of arrows between points 17A and 17M. The path between these two points is parallel to the magnetic axis 11 (hereafter parallel path). Even though this parallel path is the same length and distance from the magnet as the previous perpendicular path between points 16A and 16M, a bar magnet would rotate further (about 270 degrees) traveling from points 17A to 17M. If both paths had been extended infinitely far on either side of the magnet, then both the perpendicular and parallel paths would have produced a 360 degree rotation. However, the strength of the magnetic field decreases with distance and the parallel path always produces a greater rotation than the perpendicular path when the translation distance is limited to regions of relatively high magnetic field strength.

Figure 3:
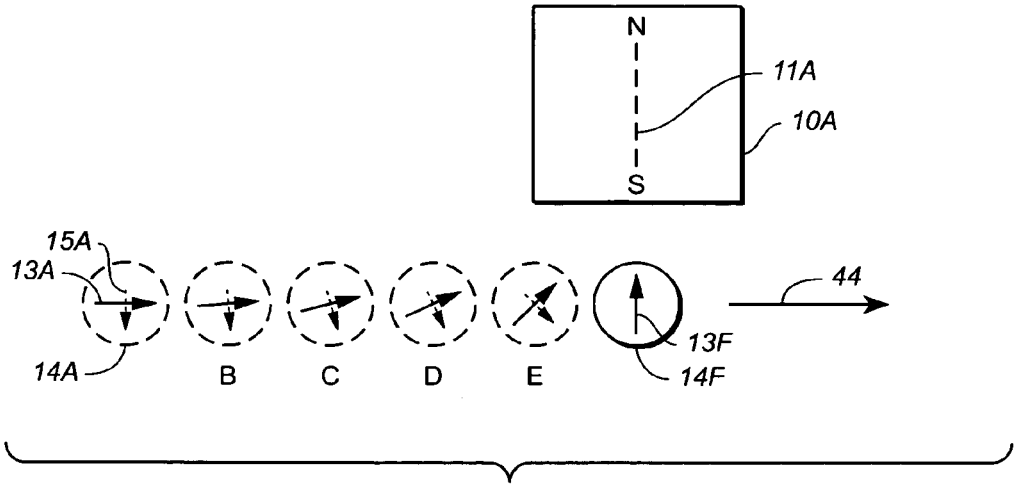
FIG. 3 is a schematic view of a stationary magnet and a rotary magnet translating perpendicular to the magnetic axis.

FIG. 3 expands on the concepts described in FIG. 2. FIG. 3 has a stationary magnet 10A with a magnetic axis 11A. In FIG. 3, magnet 14 is either a spherical magnet or a cylindrical magnet. If magnet 14 is considered a cylindrical magnet, then the cylinder is seen from the end so that it appears circular. The arrow 13 represents the magnetic axis of the magnet, but the arrowhead is located at the north magnetic pole, so arrow 13 also shows the direction of magnetization. Note that if magnet 14 is considered to be a cylindrical magnet, then the direction of magnetization is across the diameter of the cylinder. This direction of magnetization will be called diametrically magnetized. For ease of discussion, magnet 14 will be considered a diametrically magnetized cylinder but other magnet shapes such as a cube exhibit a similar behavior.

FIG. 3 shows a series of circles representing the movement of cylindrical magnet 14 starting from position 14A and ending at position 14F. The magnetic axis arrow 13 makes approximately a 90-degree rotation from position 13A to position 13F as the cylinder is moved from position 14A to 14F. This magnetic alignment presumes that the cylindrical magnet is free to rotate about the cylindrical axis, so the magnetic axis will always align with the local magnetic field as previously discussed in FIG. 2. With this free rotation alignment, a cylindrical magnet 14 will always be attracted to magnet 10A and the direction of the magnetic force is also the direction of the arrows 13A through 13F in the various locations.

It is presumed that the motion of magnet 14 is constrained to only be along the path represented by arrow 44. In this case, magnet 14 would stop at position 14F because the magnetic force is perpendicular to path 44 at this point. In fact, location 14F is the point of closest approach to magnet 10A. This is the point where the strongest magnetic coupling occurs and movement of rotary magnet 14 away from location 14F is resisted.

Now, suppose that the cylindrical magnet 14 at location 14A was forced to a magnetic alignment that was not aligned with the magnetic field from magnet 10A. For example, suppose that the cylindrical magnet at location 14A was rotated 90 degrees so that the magnetic direction is shown by the small arrow 15A. There would be a torque on the cylindrical magnet 14 attempting to rotate the cylindrical magnet back into alignment with the magnetic field from magnet 10A. Also, there would now be magnetic repulsion between magnets 10A and 14A.

If magnet 14 is translated between positions 14A and 14F and allowed to rotate, but if this rotation is restrained by an optimum amount of friction, then: the magnetic orientation of magnet 14 will always lag behind the frictionless orientation; translational motion between positions 14A and 14F will be opposed by magnetic repulsion; and translational energy will be converted to frictional heating of the rotating magnet.

The translational motion will want to stop at the point of closest approach at position 14F. It will be explained later that viscous drag is the preferred source of friction because viscous drag does not stick and the amount of drag depends on the rotation rate. In FIG. 3 this means that when the cylindrical magnet stops at the point of closest approach, at position 14F, the magnetic axis 13F will eventually align with the magnetic field of magnet 10A.

The principles taught here have application to doors because energy can be removed from a closing door without any physical contact if a stationary magnet, such as 10A, is attached to the doorframe and a rotary magnet, such as 14 is attached to the door (or vice versa). The door can be held in the closed position because the rotary magnet resists movement away from position 14F in FIG. 3. This will be explained in more detail infra.

In FIG. 3, the magnetic direction of the rotary magnet made a 90 degree rotation from position 13A to 13F and there would be a 180 degree rotation if the magnetic axis started off aligned with arrow 15A and rotated to an orientation shown by 13F. The small arrows in FIG. 3 comparable to arrow 15A represent the magnetic orientation at a particular location that produces the maximum amount of torque. The actual orientation of a magnet at each location depends on many factors such as the speed of translation, the strength of the magnets and the amount of drag on the rotary magnet.

Figure 4:
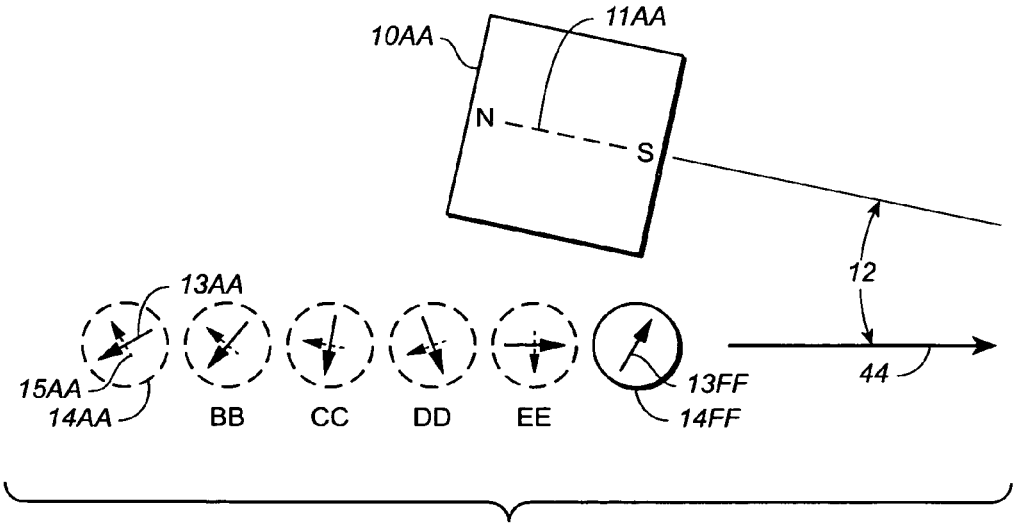
FIG. 4 is a schematic view of a stationary magnet and rotary magnet translating generally parallel to the magnetic axis.

The amount of energy that can be removed by friction depends on the amount of rotation of the rotary magnet. Therefore, it is desirable to increase the amount of rotation. FIG. 4 shows another configuration that achieves more rotation of the rotary magnet than the configuration in FIG. 3. Magnet 10AA in FIG. 4 is comparable to magnet 10A in FIG. 3, except the magnet 10AA and magnetic axis 11AA have a different orientation. It should be noted that in FIG. 3, the magnetic axis 11A is approximately perpendicular to the direction of motion 44. This motion perpendicular to the magnetic axis 11A is comparable to path 16A to 16M in FIG. 2. In FIG. 4 the magnetic axis 11AA is almost parallel with the direction of motion. This is comparable to path 17A to 17M in FIG. 2. It should be noted that the magnetic axis 11AA is not exactly parallel to the direction of translation as designated by arrow 44. Angle 12 designates the amount that the magnetic axis 11AA differs from being parallel to 44.

FIG. 4 shows a progression of a cylindrical magnet from position 14AA to 14FF. This is comparable to the progression previously discussed in FIG. 3. One difference is that because of the tilt (angle 12) the point of closest approach 14FF is near one corner of magnet 10AA rather than at the middle of magnet 10A in FIG. 3.

The amount of rotation between magnetic direction 13AA and 13FF is about 210 degrees rather than approximately 90 degrees between 13A and 13F in FIG. 3. The small arrow 15AA is the 90-degree orientation that produces the maximum torque as previously explained in FIG. 3. If the rotary magnet at position 14AA is forced to have this orientation, then the total rotation between position 15AA and 14FF is about 300 degrees compared to approximately 180 degrees for a comparable translation in FIG. 3. Therefore, the orientation shown in FIG. 4 clearly produces more rotation than the orientation shown in FIG. 3.

Magnet 10AA in FIG. 4 is tilted at angle 12 compared to translation direction 44. The reason for this tilt is to achieve a single stopping point at 14FF. If the magnetic axis 11AA were parallel to translation direction 44, then there would be two stable points where the cylindrical magnet 14 could come to rest. These two stable points would be aligned with each vertical edge of magnet 10AA. This would mean that a door could stop at either of two points, depending how hard it was closed. It only takes a few degrees of tilt to eliminate this problem and give a single stopping point. The optimum tilt angle must be determined experimentally because it depends on both magnetic and geometrical factors.

Figure 5:
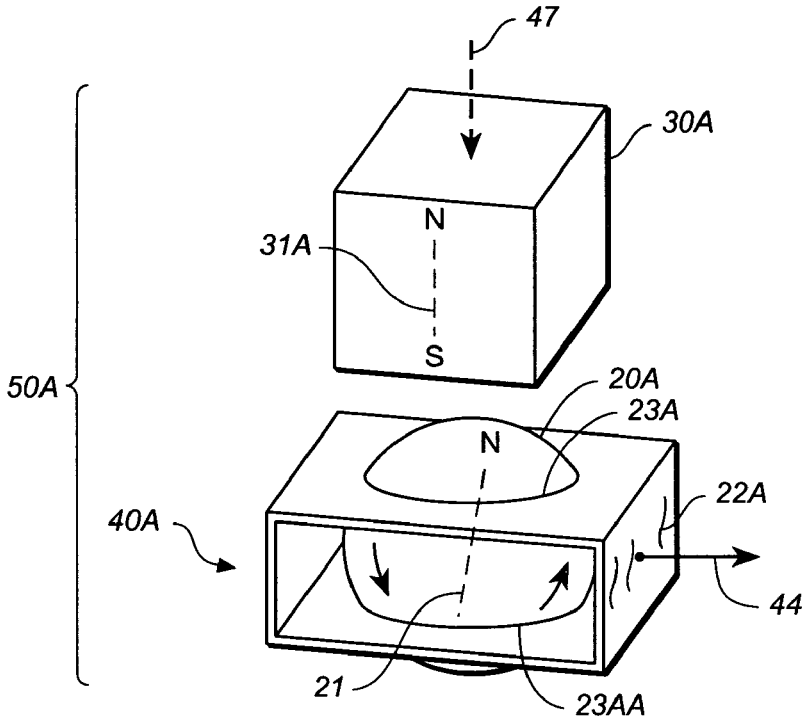
FIG. 5 is a perspective view of an energy absorbing magnetic coupling device utilizing a spherical rotary magnet.
Figure 6:
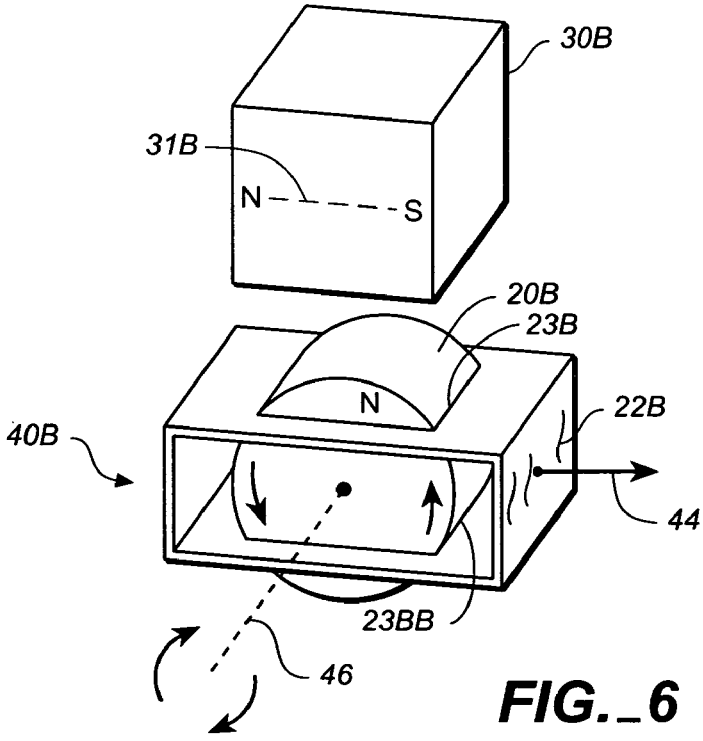
FIG. 6 is a perspective view of an energy absorbing magnetic coupling device utilizing a cylindrical rotary magnet.

FIGS. 5 and 6 are perspective views of two variations of energy absorbing magnetic coupler devices. FIG. 5 shows an energy absorbing magnetic coupling device 50. In FIG. 5, spherical magnet 20A with a magnetic axis 21A is retained in housing 22A. The housing 22A shown in FIG. 5 is made of non-magnetic sheet metal. The housing has two holes 23A and 23AA slightly smaller than the diameter of the spherical magnet. Part of the spherical magnet 20A protrudes through both of these two holes. The spherical magnet is captured in the housing, but the spherical magnet can still rotate. There will be a predetermined amount of frictional drag on any rotation of the sphere. This friction could be controlled by the amount of elasticity in housing 22A. The combination of the spherical magnet and the housing is an example of a combination that will be called a rotary magnet assembly 40A.

FIG. 5 also shows a second magnet 30A. The shape of magnet 30A is not critical, but a good shape is either a cylinder or a cube of the same general size dimensions as the diameter of the spherical magnet. This magnet 30A will be referred to as the reference magnet. The reference magnet has a magnetic axis 31A that is depicted as being perpendicular to the direction of travel (arrow 44) of the rotary magnet assembly 40A. The magnetic axis can be oriented at other angles as previously discussed. FIG. 5 also shows an alternative translation direction 47 that will be discussed infra.

The two magnets are prevented from contacting each other because both the reference magnet 30A and the rotary magnet assembly 40A are attached to external components that permit motion only along the vector defined by arrow 44. For example, in FIG. 1, one of the magnets is attached to the door and the other magnet is attached to the doorframe. Closing the door produces the desired motion generally in one dimension along arrow 44 (the slight arc resulting from the hinged motion of the door can be ignored). Also, it does not make any difference whether the reference magnet or the rotary magnet assembly moves. All that is important is the relative motion between the two components. Subsequent figures will show the rotary magnet moving, but this is just done for consistency.

The inventive device works best when strong, compact magnets are used. Therefore rare earth magnets are preferred, especially neodymium iron boron magnets also known as NdFeB magnets.

FIG. 6 shows another energy absorbing magnetic coupling device similar to FIG. 5, except a cylindrical magnet 20B is used instead of the spherical magnet 20A in FIG. 5. In FIG. 6, non-magnetic housing 22B has two holes 23B and 23BB. These are rectangular holes that allow a portion of the cylindrical magnet 20B to protrude above and below the housing 22B and the holes are sized to capture the cylindrical magnet. The housing 22B permits cylindrical magnet 20B to rotate around axis 46, but any rotation has a predetermined amount of frictional drag due to the friction of the cylinder against the edges of holes 23B and 23BB.

FIG. 6 also has rotary magnet assembly 40B traveling along vector 44. The reference magnet 30B can be any size and shape, but a cubic magnet is preferred. Also, the magnetic axis 31B is shown as being approximately parallel to the translation vector 44. However, the magnetic axis should be slightly tipped relative to 44 as previously discussed in FIG. 4.

FIGS. 5 and 6 illustrate two different orientations for the magnetic axis of the reference magnet (31A and 31B). The orientation of axis 31A in FIG. 5 has less energy removal potential but a stronger force holding the final position. The orientation of axis 31B in FIG. 6 has more energy removal potential, but does not exhibit as much force holding the final position. Other orientations of the reference magnet can be used to achieve intermediate characteristics.

In FIG. 6, the housing 22B should be oriented so that axis 46 of the cylindrical magnet 20B will be generally perpendicular to the translation vector 44. No special orientation was required for the housing in FIG. 5 because the spherical magnet 20A in FIG. 5 can rotate around any axis and the spherical magnet automatically rotates around the optimum axis.

Figure 7:
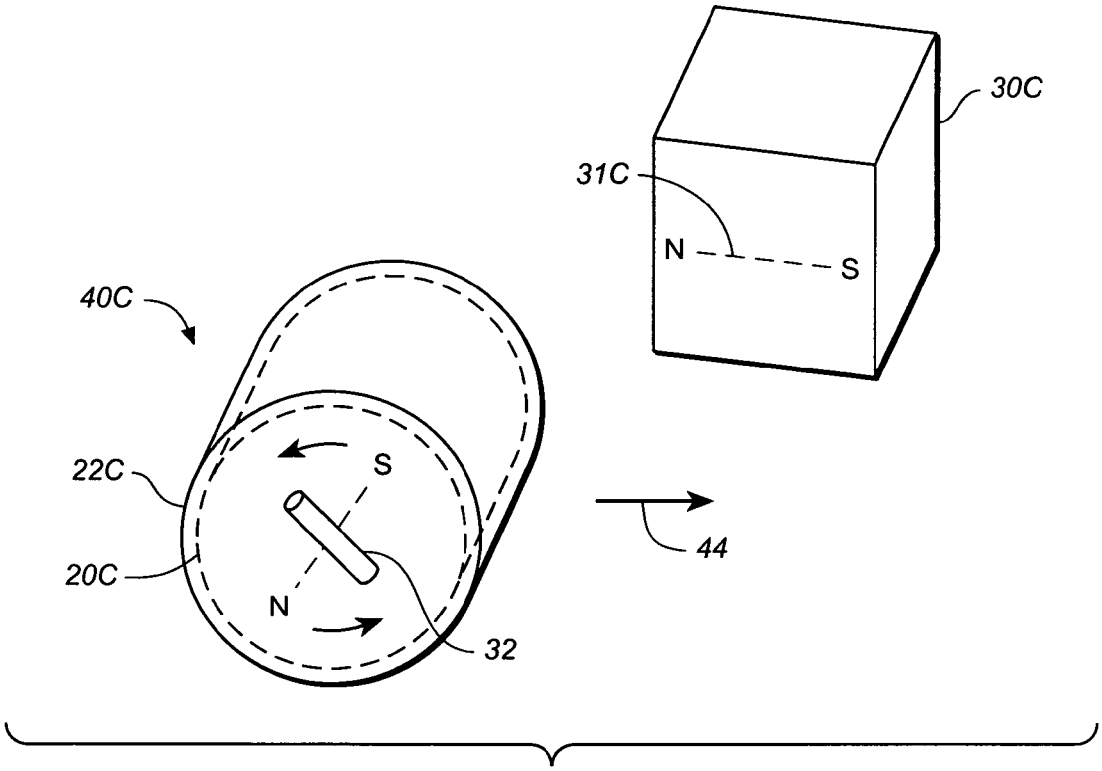
FIG. 7 is a perspective view of the preferred embodiment with a cylindrical magnet in a cylindrical housing.
Figure 8:
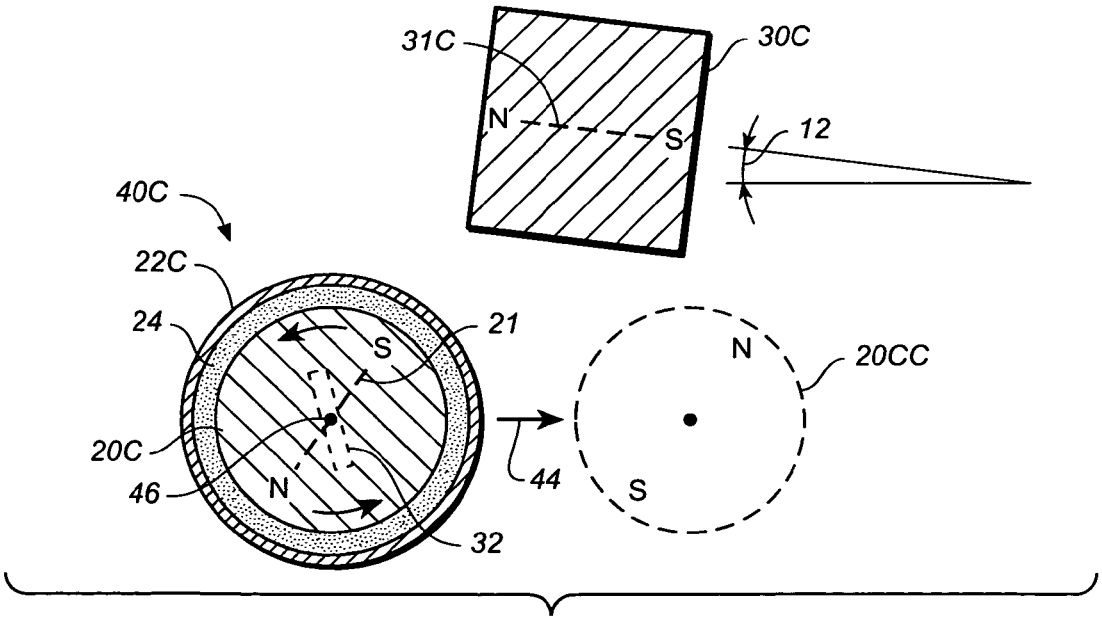
FIG. 8 is a cross-sectional view of the preferred embodiment shown in FIG. 7.

FIG. 7 shows a perspective view of the preferred embodiment and FIG. 8 shows a cross-sectioned view of the preferred embodiment. Both of these figures will be discussed together. FIGS. 7 and 8 show a cubic reference magnet 30C with a magnetic axis 31C. FIG. 8 shows that the magnetic axis 31C is slightly tilted at angle 12 relative to the translation direction 44. The rotary magnet assembly 40C consists of a cylindrical magnet 20C that is diametrically magnetized with a magnetic axis 21C. The cylindrical magnet 20C is contained in a non-magnetic cylindrical housing 22C that permits magnet 20C to rotate around rotational axis 46.

In FIG. 8 it can be seen that between magnet 20C and housing 22C there is a space 24. In the preferred embodiment, space 24 would contain a very viscous (glutinous) substance that produces a predetermined viscous drag on the rotary magnet 20C. For example, this viscous substance could be thick grease, or even a sticky gum material. A magnetic liquid might also provide desirable drag. The drag occurs because the housing 22C is prevented from rotating by an external mounting not shown. The size of space 24 in FIG. 8 has been enlarged for illustration purposes.

FIGS. 7 and 8 do not show any means to maintain the cylindrical magnet 20C in the center of the housing 22C. It is not essential to center the cylindrical magnet, but this centering is desirable to maintain a predetermined viscous drag. The cylindrical magnet could be centered using pivot points, similar to an axle, which contact each end of the cylinder. There are other methods of maintaining a constant viscous drag, but these are beyond the scope of this invention and not required for operation. While the preferred embodiment uses a viscous fluid, it is also possible to utilize only contact friction to produce the desired, substantial drag as previously discussed in FIGS. 5 and 6.

Translating the rotary assembly 40C along the path designated by arrow 44 causes the cylindrical magnet 20C to rotate as indicated by the rotation arrows. FIG. 8 shows a dashed circle 20CC. This is the approximate position of the magnet 20C when the rotational assembly comes to a stop at the point of closest approach. This is the lowest energy position and once the rotational assembly stops at this position, the magnets resist movement away from this position.

FIGS. 7 and 8 show a small bias magnet 32 attached to the outside of the cylindrical housing which does not rotate. Bias magnet 32 is depicted as a small bar magnet, but any shape magnet can be used. This bias magnet has the purpose of orienting the cylindrical magnet 20C to the optimum orientation for the maximum energy removal. The bias magnet 32 only influences the orientation of the cylindrical magnet 20C when the rotary assembly 40C is away from the much stronger reference magnet 30C. For example, when the door is opened, the rotary and reference magnets are widely separated. When the door is open, the weak bias magnet can rotate the rotary magnet because viscous drag has the property that the drag is proportional to rotational speed. Therefore a slow rotation encounters only a small drag while a fast rotation encounters a large drag. The weak bias magnet is then able to slowly orient the rotary magnet but closing the door produces a rapid rotation and high drag. This high drag is sufficient to absorb the translational energy of the closing door and convert this energy into heat.

In FIG. 4, it was explained that when a cylindrical magnet was in position 14AA, the optimum orientation for maximum energy removal would be to have the magnetic direction aligned with small arrow 15AA. The purpose of a bias magnet is to prepare the rotary magnet to the optimum orientation for maximum energy removal. A bias magnet can be placed anywhere near the rotary magnet, not just in the position shown. The fringing magnetic field of both the rotary magnet and the bias magnet permits a bias magnet to do its job from any close location provided that the bias magnet is properly oriented to produce the desired alignment of the rotary magnet.

There is another way of orienting the rotary magnet when the reference magnet is removed. This is through a design that can be referred to as Agravitational bias@. The key of any bias means is to apply a small force that can rotate the rotary magnet over time. If the rotary magnet was weighted unevenly, then gravity could slowly rotate the rotary magnet into the optimum orientation. The rotary magnet has a rotary axis 46 (FIG. 6) and a center of gravity. Normally the center of gravity would be at the geometric center of the rotary magnet if there were a uniform density and symmetrical shape. When the rotary axis 46 (FIG. 6) passes through the center of gravity, then there is no gravitational bias. However, shaping or weighting the rotary magnet differently results in an axis of rotation that does not pass through the center of gravity. Then the rotary magnet will eventually come to rest with the center of gravity below the axis of rotation. This is a bias means that can be used to orient the rotary magnet when the reference magnet is removed. However, the bias magnet method is preferred because it can apply more force in a compact volume.

It was previously mentioned that the housing should be made of non-magnetic material. The requirement is that the housing does not block transmission of magnetic fields. The easiest way of achieving this is to use non-magnetic materials, but a small amount of ferromagnetic material can be tolerated in the housing.

EXAMPLE 1

A successful experiment was performed of a design similar to the preferred embodiment except that a spherical magnet was used rather than a cylindrical magnet. The rotary magnet, reference magnet and bias magnet were all made of the rare earth magnetic material NdFeB. The rotary magnet was a 9.5 mm diameter sphere, the reference magnet was a 9.5 mm cube and the bias magnet was a disk 9.5 mm diameter and 3 mm thick. The bias magnet was removed from the rotary magnet surface by about 7 mm so that the bias magnet produced a much weaker magnetic field than the reference magnet when the reference magnet is at the point of closest approach (about 2 mm from the rotary magnet).

Mating two hemispherical cavities formed a spherical cavity. Each hemisphere was slightly larger than the 9.5 mm diameter of the spherical magnet. The hemispherical cavities were drilled into 6.3 mm thick aluminum. A first test was performed using axle grease as the viscous material filling a spherical space similar to space 24 in FIG. 8. There was definitely some energy removal when the spherical magnet was rotated, but for the cavity dimensions tested, the grease did not provide enough drag. A second test used thick, sticky glue that was obtained from a glue tray type mousetrap. After getting the correct coating thickness, this very sticky substance gave the correct amount of drag.

The apparatus was then tested on a door. The reference magnet was attached to a full size door and the rotary magnet housing was held stationary. The reference magnet was oriented perpendicular to the translation direction similar to that illustrated in FIG. 5. When the door was closed at a normal closing speed, the door was observed to slow down as it approached the intended stopping point (the point of closest approach). Then the door gently and silently came to a stop at the correct point. Closing the door with more speed caused a slight overshoot, but then the door reversed direction and stopped at the correct point. Still more closing speed caused the door to hit a mechanical stop, but the door then reversed direction and stopped at the correct point. The door closed silently as long as the door was closed with energy (speed) less than the energy absorption capacity of the apparatus. This is to say that the door closed silently as long as it did not hit the stop.

The bias magnet was observed to take about two seconds to reorient the spherical magnet when the door was opened (i.e., when the reference magnet was removed). If the door was closed before about two seconds, there was a noticeable reduction in the energy absorbing characteristics. Eliminating the bias magnet still usually resulted in the door stopping at the correct point, but the door was much more likely to hit the door stop before the door came to rest at the correct point. The tests showed that the bias magnet was not essential, but it was desirable.

EXAMPLE 2

Thus far, all of the examples had the rotary magnet 20 translate only along a path 44 which does not intersect the reference magnet 30. Another test proved that energy removal could occur even when the reference magnet 30A approached rotary magnet 20A from the direction 47 in FIG. 5. This is the direction parallel to the magnetic axis 31A. The reference magnet would collide with the rotary magnet if it did not first hit a stop. In this experiment, a bias magnet (not shown in FIG. 5) had previously oriented the rotary magnet to an orientation that initially repelled the reference magnet coming from direction 47. Therefore, the initial repulsion removed translational energy when the reference magnet approached. Then the rotary magnet turned 180 degrees inside the housing and the initial repulsion was followed by magnetic attraction. The two magnets were prevented from colliding by a stop. This experiment shows that energy removal can occur with any orientation and translation direction provided that a bias magnet can properly orient the rotary magnet prior to the translation. The actual experiment was performed with the experimental spherical magnet apparatus previously described, so viscous drag was used rather than frictional drag.

Figure 9:
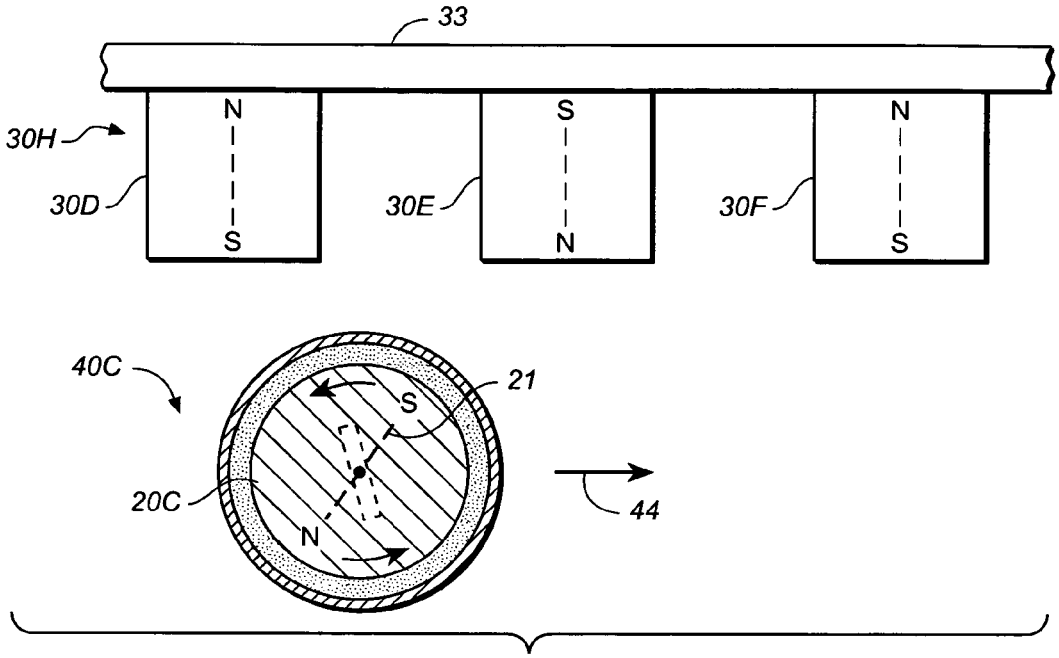
FIG. 9 is a cross-sectional view of an embodiment which utilizes a multi-polar reference magnet.

FIG. 9 shows the use of a multi-polar reference magnet. The rotary magnet assembly 40C in FIG. 9 was previously described in FIGS. 7 and 8. The multi-polar reference magnet assembly 30H consists of a ferromagnetic bar 33 and multiple magnets 30D, 30E and 30F, which have been assembled to have alternating north and south poles. When the rotary magnet assembly 40C is translated along path 44, the cylindrical magnet 20C makes a 180 degree rotation with each reversal of magnetic polarity from the adjacent reference magnets. Therefore multiple magnets such as 30D, 30E and 30F can be added to achieve any amount of magnetic braking desired. The multi-polar reference magnet design is capable of removing more energy that a single reference magnet, but it is more difficult to make the rotary magnet assembly stop at a predetermined position with a multi-polar reference magnet.

It has previously been stated that any shape magnet will exhibit a rotation if it is properly mounted and translated through the fringing magnetic field of a reference magnet. The term A properly mounted@ will be explained now. The ideal mounting for a rotary magnet to obtain maximum torque meets the following four goals: 1) the rotary magnet should be able to rotate about a rotational axis that is perpendicular to the magnet=s magnetic axis; 2) the rotational axis should pass through the center of the rotary magnet; 3) the rotational axis should be perpendicular to the translation direction; and 4) the rotational axis should be perpendicular to the magnetic axis of the reference magnet.

Meeting these four goals achieves maximum torque for a specific magnet size and a specific magnet separation. However, energy can be removed with a wide range of reference magnet orientations and a wide range of translation directions. In fact, if there is the proper drag on the rotary magnet, the only condition that does not remove energy from the rotary magnet is when either the translation direction 44, the magnetic axis 21 or the magnetic axis 31 is parallel to the rotation axis 46 (FIGS. 6 and 8).

A magnet in any shape (for example a cube) could be used as a rotary magnet if it is properly mounted, for example mounted on axle. The axle then becomes the rotational axis. If the above four points were roughly met, then any magnet shape could rotate and become a rotary magnet.

The above four points are automatically and accurately fulfilled with a spherical magnet when it is mounted so that it can rotate in any direction. The spherical magnet will naturally choose an orientation and axis of rotation that fulfills the above goals. A diametrically magnetized cylindrical magnet automatically fulfills points number 1 and 2 above if the cylinder is mounted so that it can rotate around its cylindrical axis. However, the housing for a cylindrical rotary magnet should be oriented properly to fulfill points number 3 and 4 above in order to obtain the maximum torque and maximum energy absorption when drag is added.

FIGS. 5 and 6 showed one type of housing where the rotary magnet was held in position with properly sized holes. FIGS. 7 and 8 show another type of housing where a cylindrical rotary magnet was held inside a cylindrical cavity or a spherical magnet was held inside a spherical cavity. There are many different ways of constructing the housing for the rotary magnet. For example, a cylindrical rotary magnet could be housed inside a rectangular or cubical chamber. The primary drag could then be supplied through the flat ends of the cylindrical magnet. Therefore, the shape of the housing is not critical, but the function of the housing must meet the following four requirements: (1) It must support the rotary magnet; (2) it must not block the transmission of a magnetic field; (3) it must allow the rotary magnet to rotate; (4) it must provide a predetermined drag on the rotary magnet.

Finally, all the examples given thus far had the reference magnet not able to rotate. However, the reference magnet could also be another rotary magnet assembly.

Accordingly, the invention may be characterized as an energy absorbing magnetic coupling device comprising a rotary magnet assembly including a first magnet rotatably retained in a housing, such that there is a substantial drag on rotation of said first magnet within said housing; a reference magnet having a magnetic axis; the rotary magnet and the reference magnet can be translated relative to each other along a predetermined translation path which has a point of closest approach; the magnetic axis of the reference magnet is oriented such that the relative translation exerts a torque on the first magnet and causes it to rotate inside the housing, and drag on the first magnet extracts energy from this rotation and converts this energy to heat, and acting to stop the relative motion at the point of closest approach.

Alternatively, the invention may be characterized as a rotary magnet apparatus comprising a first magnet with a magnetic axis; a housing which holds the first magnet such that the first magnet can rotate about a rotational axis generally perpendicular to the magnetic axis, the housing including means for exerting a predetermined substantial drag on the first magnet such that rotation of said the magnet results in a predetermined energy loss.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. An energy absorbing magnetic device for providing non-contact braking and non-contact coupling for a first body in relation to a second body device comprising:

a rotary magnet assembly mounted on a first body, said rotary magnet assembly including a first magnet rotatably retained in a housing;

a highly viscous substance disposed around said first magnet so as to exert a drag on said first magnet and thus resist the rotation of said first magnet within said housing;

a reference magnet mounted on a second body and having a magnetic axis;

wherein either one of said first and said second body is movable relative to the other;

wherein said rotary magnet and said reference magnet can be translated relative to each other along a predetermined translation path which has a point of closest approach; and wherein said magnetic axis of said reference magnet is oriented such that the translation of said reference magnet relative to said rotary magnet along said translation path exerts a torque on said first magnet, causes causing it to rotate inside said housing, thereby inducing a drag acting on said first magnet from said drag means, and initially acts to slow the relative translation with non-contact braking through the magnetic repulsion between said rotary magnet and said reference magnet, and ultimately acts to stop the relative translation in a non-contact coupling at said point of closest approach through the magnetic attraction of said rotary magnet and said reference magnet, and wherein the drag on said first magnet extracts energy from the rotation of said first magnet and converts this energy to heat.

2. The energy absorbing magnetic coupling device of claim 1 wherein said first magnet is spherical.

3. The energy absorbing magnetic coupling of claim 2 wherein said housing is a spherical cavity.

4. The energy absorbing magnetic coupling device of claim 1 wherein said first magnet is a diametrically magnetized cylinder.

5. The energy absorbing magnetic coupling device of claim 4 wherein said housing is a cylindrical cavity.

6. The energy absorbing magnetic coupling device of claim 1 wherein said first magnet is a neodymium iron boron magnet.

7. The energy absorbing magnetic coupling device of claim 1 wherein said magnetic axis of said reference magnet is tilted at an angle relative to said translation path.

8. The energy absorbing magnetic coupling device of claim 1 further including means to orient said first magnet to the optimum orientation for the maximum energy removal.

9. The energy absorbing magnetic coupling of claim 8 wherein said means to orient said first magnet comprises a bias magnet.

10. The energy absorbing magnetic coupling of claim 8 wherein said means to orient said first magnet comprises an uneven weighting of said first magnet.

11. The energy absorbing magnetic coupling of claim 1 wherein said first magnet has a first magnet magnetic axis, and said first magnet rotates about a rotational axis that is perpendicular to all of the following: said first magnet magnetic axis, said translation path, and said magnetic axis of said reference magnet.

12. The energy absorbing magnetic coupling of claim 1 wherein said reference magnet is a stationary magnet that comprises a multi-polar magnet assembly including a plurality of magnets assembled to have alternating north and south poles.

13. An energy absorbing magnetic non-contact braking and non-contact coupling device comprising:

a rotary magnet assembly mounted on a first body, said rotary magnet assembly including a spherical magnet rotatably retained in a spherical cavity in a housing;

drag means positioned so as to exert a drag on said spherical magnet and thus resist the rotation of said spherical magnet within said housing;

a reference magnet mounted on a second body, said reference magnet having a magnetic axis;

wherein said spherical magnet and said reference magnet can be translated relative to each other along a predetermined translation path which has a point of closest approach; and wherein said magnetic axis of said reference magnet is oriented such that the translation of said reference magnet relative to said rotary magnet along said translation path exerts a torque on said first magnet, causing it to rotate inside said housing, thereby inducing a drag acting on said first magnet from said drag means, and acts to stop the relative translation at said point of closest approach, and wherein the drag on said first magnet extracts energy from the rotation of said first magnet and converts this energy to heat.

14. An energy absorbing magnetic non-contact braking and non-contact coupling device comprising:

a rotary magnet assembly mounted on a first body, said rotary magnet assembly including a first magnet rotatably retained in a housing;

drag means positioned so as to exert a drag on said first magnet and thus resist the rotation of said first magnet within said housing;

a reference magnet mounted on a second body, said reference magnet having a magnetic axis;

magnet orienting means to orient said first magnet to the optimum orientation for the maximum energy removal, wherein said magnet orienting means comprises an uneven weighting of said first magnet;

wherein said first magnet and said reference magnet can be translated relative to each other along a predetermined translation path which has a point of closest approach; and wherein said magnetic axis of said reference magnet is oriented such that the translation of said reference magnet relative to said rotary magnet along said translation path exerts a torque on said first magnet, causing it to rotate inside said housing, thereby inducing a drag acting on said first magnet from said drag means, and acts to stop the relative translation at said point of closest approach, and wherein the drag on said first magnet extracts energy from the rotation of said first magnet and converts this energy to heat.

* * * * *